US006713965B2

(12) United States Patent
Jang et al.

(10) Patent No.: US 6,713,965 B2
(45) Date of Patent: Mar. 30, 2004

(54) MICROWAVE OVEN

(75) Inventors: Seong-Deog Jang, Suwon (KR); Dae-Sung Han, Hwasung (KR); Yong-Woon Han, Kunpo (KR); Han-Seong Kang, Suwon (KR); Kwang-Seok Kang, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/188,913

(22) Filed: Jul. 5, 2002

(65) Prior Publication Data

US 2003/0117078 A1 Jun. 26, 2003

(30) Foreign Application Priority Data

Dec. 24, 2001 (KR) ..... 2001-84398

(51) Int. Cl.[7] ..... H01J 25/50; H05B 41/16

(52) U.S. Cl. ..... 315/39.51; 315/224; 315/283

(58) Field of Search ..... 315/39.51, 39.53, 315/283, 224, 206, 207, 208, 254; 333/177, 181; 331/86, 87; H01J 25/50; H05B 41/16

(56) References Cited

U.S. PATENT DOCUMENTS 4,142,082 A * 2/1979 Israel ..... 219/760
4,163,175 A 7/1979 Tashiro ..... 315/39.51
4,988,922 A * 1/1991 Shoda et al. ..... 315/223
5,053,682 A * 10/1991 Shoda et al. ..... 315/223
5,097,182 A * 3/1992 Kelly ..... 315/219
5,115,168 A * 5/1992 Shoda et al. ..... 315/223
5,300,744 A * 4/1994 Maehara et al. ..... 219/687
5,565,781 A * 10/1996 Dauge ..... 324/403
5,909,086 A * 6/1999 Kim et al. ..... 315/111.21
5,977,713 A 11/1999 Ochiai et al. ..... 315/39.51
6,297,568 B1 * 10/2001 Kempinski ..... 307/125

* cited by examiner

*Primary Examiner*—Don Wong
*Assistant Examiner*—Trinh Vo Dinh
(74) *Attorney, Agent, or Firm*—Staas & Halsey LLP

(57) ABSTRACT

A microwave oven includes a filter unit having choke coils disposed on ground lines, to which low and high voltage units are grounded, and on a power line connected to a controller so as to block high frequency noise. Impedances of the ground and power lines are greatly increased by the choke coils. Accordingly, noise is prevented from being radiated to the outside through the ground lines, and from flowing to the controller through the power line, thus allowing the controller to perform a stable operation.

24 Claims, 2 Drawing Sheets

MICROWAVE OVEN

CROSS-REFERENCE TO RELATED APPLICATIONS

This application claims the benefit of Korean Application No. 2001-84398, filed Dec. 24, 2001 in the Korean Industrial Property Office, the disclosure of which is incorporated herein by reference.

BACKGROUND OF THE INVENTION

1. Field of the Invention

The present invention relates to microwave ovens, and more particularly, to a microwave oven which blocks high frequency noise flowing through ground and power lines.

2. Description of the Related Art

Generally, a microwave oven carries out a cooking operation by converting commercial alternating current (AC) power into a high voltage to drive a magnetron. Since the microwave oven uses the commercial AC power, it is difficult to install and use the microwave oven in transportation vehicles such as cars.

Recently, a microwave oven has been developed to use direct current (DC) power, such as a battery, to cook foods. This type of microwave oven employs an inverter circuit to convert a DC voltage into an AC voltage required to drive a magnetron.

FIG. 1 shows a conventional microwave oven using DC power comprising a DC power source 1, a low voltage unit including a switching unit 2 and an inverter unit 3 connected to a primary side of a high voltage transformer 4, a high voltage unit including a magnetron driving unit 5 connected to a secondary side of the high voltage transformer 4, a magnetron filter box 6, and a controller 10. The magnetron filter box 6 includes a magnetron 7, and a low pass filter which comprises choke coils 8 and feed-through condensers 9.

The switching unit 2 includes a door switch, a low voltage transformer, and a typical noise filter, and supplies operating power, which is voltage-dropped by the low voltage transformer, through a power line connected to the controller 10. The inverter unit 3 comprises a push-pull circuit having switching devices, such as Field Effect Transistors (FETs), and is switched by a control signal from the controller 10 to convert DC power into AC power.

The high voltage transformer 4 induces the AC power converted according to a turn ratio of a primary coil L1 to a secondary coil L2 as a high AC voltage, and supplies the high AC voltage to the magnetron driving unit 5. The magnetron driving unit 5 supplies a high DC voltage of 4000V to the magnetron 7 using a half-wave voltage doubler circuit (not shown) having a high voltage diode and a high voltage condenser.

One end of each of the switching unit 2 of the low voltage unit and the magnetron driving unit 5 of the high voltage unit is grounded through a ground line.

In the conventional microwave oven using the DC power as a power source, since the controller 10 drives the inverter unit 3 at a high usable frequency of 20 to 50 KHz, electrical energy flows are exchanged between the low and high voltage units, thus causing high frequency noise to be widely generated. Furthermore, the high frequency noise flows through the ground lines and radiates to the outside. Moreover, the high frequency noise flows through a power line connected to the controller 10, thereby causing the high frequency noise to disturb a control operation of the controller 10.

SUMMARY OF THE INVENTION

Accordingly, it is an object of the present invention to provide a microwave oven which blocks high frequency noise flowing through ground and power lines.

Additional objects and advantages of the invention will be set forth in part in the description which follows, and, in part, will be obvious from the description, or may be learned by practice of the invention.

To achieve the above and other objects of the present invention, there is provided a microwave oven comprising a low voltage unit which converts direct current (DC) power into alternating current (AC) power and supplies operating power, a controller which receives the operating power from the low voltage unit, a high voltage transformer having primary and secondary coils, wherein the high voltage transformer induces the AC power converted by the low voltage unit as a high AC voltage according to a turn ratio of the primary coil to the secondary coil, a high voltage unit which generates a high DC voltage from the high AC voltage induced by the high voltage transformer and supplies the high DC voltage to a magnetron, and a filter unit which blocks high frequency noise while passing a signal of a DC voltage through ground lines to which the low and high voltage units are grounded and a power line connected between the low voltage unit and the controller.

According to an aspect of the present invention, the filter unit includes at least one choke coil which increases impedances of the ground and the power lines.

BRIEF DESCRIPTION OF THE DRAWINGS

The above and other objects and advantages of the present invention will become more apparent by describing in detail a preferred embodiment thereof with reference to the attached drawings in which.

DETAILED DESCRIPTION OF THE PREFERRED EMBODIMENTS

Figure 1:
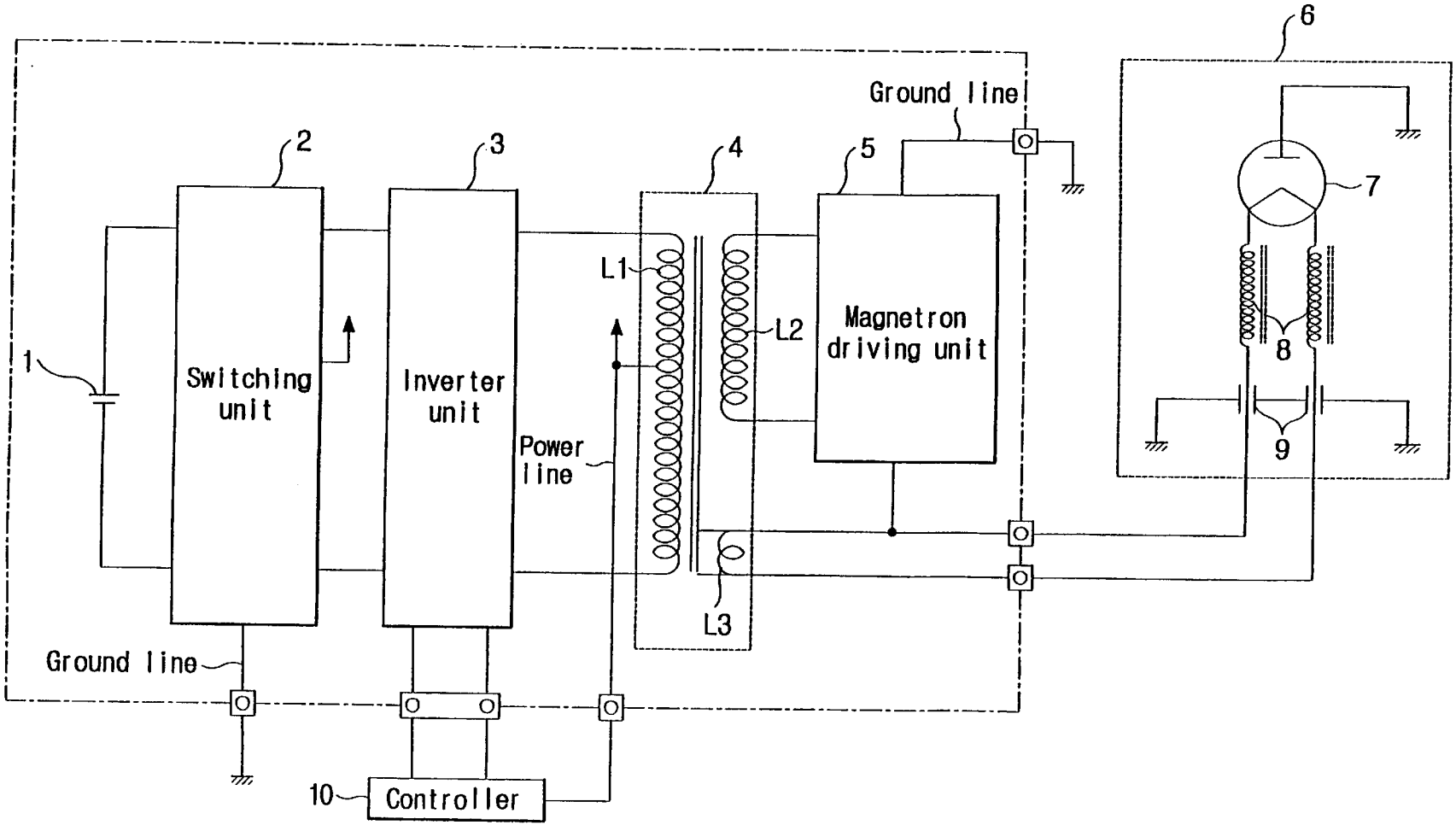
FIG. 1 (PRIOR ART)
FIG. 1 is a block diagram of a conventional microwave oven using DC power.

Reference will now be made in detail to the present preferred embodiments of the present invention, examples of which are illustrated in the accompanying drawings, wherein like reference numerals refer to like elements throughout.

The present invention can be applied to microwave ovens using AC power for a home use as well as microwave ovens using DC power as a power source. Furthermore, the present invention can be applied to microwave ovens usable with a power source selected from DC and AC power sources. For convenience and to avoid unnecessary repetition, the present invention as applied to microwave ovens using DC power is described.

Figure 2:
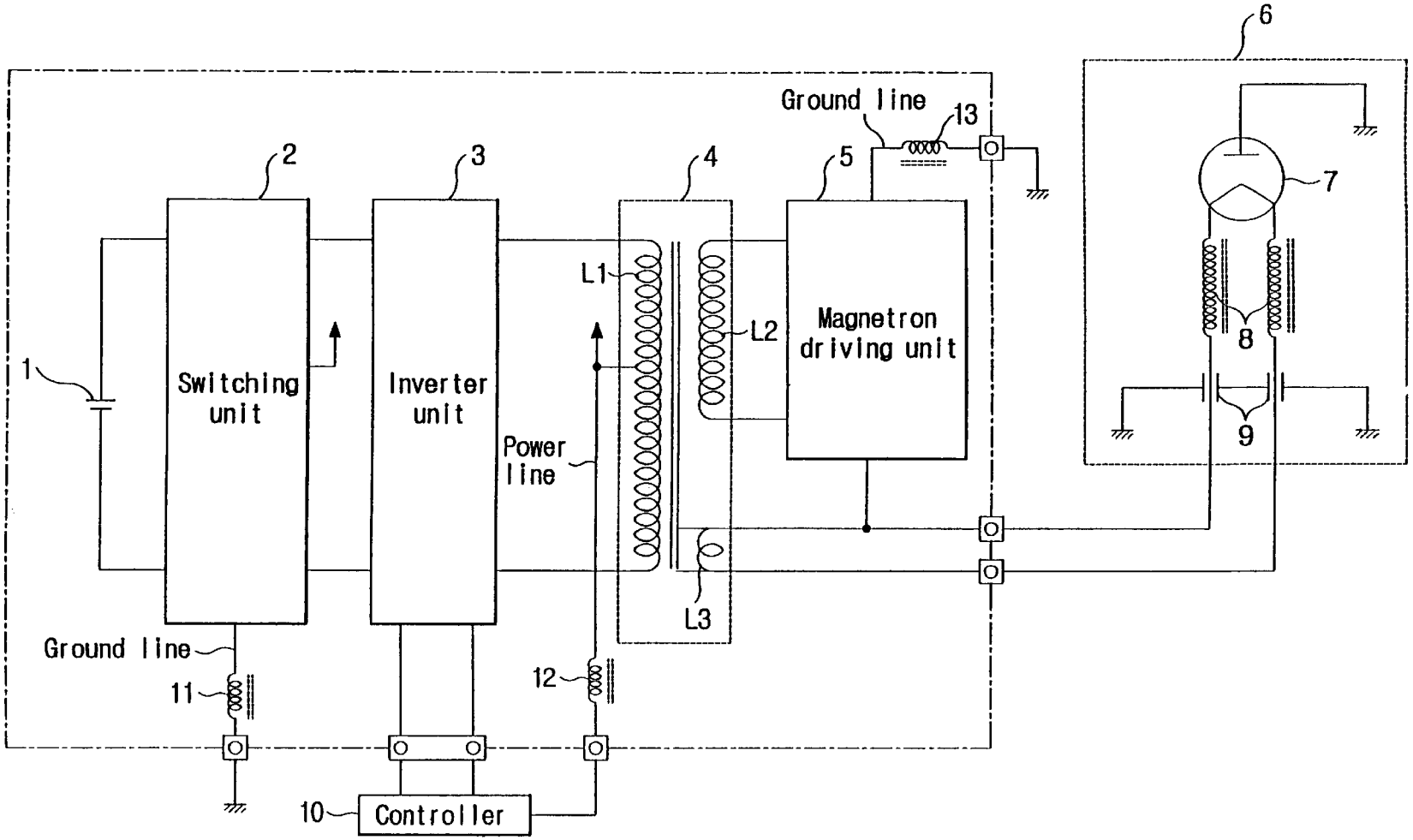
FIG. 2 is a block diagram of a microwave oven using DC power according to an embodiment of the present invention.

FIG. 2 shows a microwave oven using DC power according to an embodiment of the present invention. The microwave oven comprises a DC power source 1, a low voltage unit including a switching unit 2 and an inverter unit 3 connected to a primary side of a high voltage transformer 4, a high voltage unit including a magnetron driving unit 5 connected to a secondary side of the high voltage transformer 4, a magnetron filter box 6, and a controller 10.

The magnetron filter box 6 includes a magnetron 7, and a low pass filter which comprises choke coils 8 and feed-through condensers 9. The switching unit 2 includes a door switch, a low voltage transformer, and a typical noise filter, and supplies operating power, which is voltage-dropped by the low voltage transformer, through a power line connected to the controller 10. The inverter unit 3 comprises a push-pull circuit having switching devices, such as Field Effect Transistors (FETs), and is switched by a control signal from the controller 10 to convert DC power into AC power.

The high voltage transformer 4 induces the AC power converted according to a turn ratio of a primary coil L1 to a secondary coil L2 as a high AC voltage, and supplies the high AC voltage to the magnetron driving unit 5. The magnetron driving unit 5 supplies a high DC voltage of, for example, 4000V to the magnetron 7 using a half-wave voltage doubler circuit (not shown) having a high voltage diode and a high voltage condenser.

One end of each of the switching unit 2 of the low voltage unit and the magnetron driving unit 5 of the high voltage unit is grounded through a ground line.

The microwave oven of the present invention further includes second, third and fourth choke coils 11, 13 and 12 as a filter unit which removes high frequency noise flowing through the ground and power lines during an operation in which electrical energy flows are exchanged between the low and high voltage units.

The second and third choke coils 11 and 13 are disposed on ground lines to which the switching unit 2 of the low voltage unit and the magnetron driving unit 5 of the high voltage unit are respectively grounded. The fourth choke coil 12 is disposed on the power line connected between the switching unit 2 and the controller 10.

The second, third and fourth choke coils 11, 13 and 12 comprise corresponding inductances, and serve to increase the impedances of the ground and power lines, respectively. Accordingly, a signal of a DC voltage flows through the power and ground lines, while the high frequency noise is blocked. Therefore, when the controller 10 drives the inverter unit 3 at a high usable frequency (higher than 20 KHz), even though the high frequency noise is generated due to electrical energy flows between the low and high voltage units, radiation of the high frequency noise to the outside through the ground lines can be prevented. Furthermore, the flow of the high frequency noise to the controller 10 through the power line can be blocked.

As described above, in the microwave oven of the present invention, high frequency noise can be blocked by connecting choke coils to ground lines, to which low and high voltage units are grounded, and to a power line connected to a controller. Use of the choke coils increases impedances of the ground and power lines. Therefore, the microwave oven of the present invention can prevent noise from being radiated to the outside through the ground lines, and from flowing to the controller through the power line, thus allowing the controller to perform a stable operation.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A microwave oven comprising:

a magnetron;

a low voltage unit which converts direct current (DC) power into alternating current (AC) power and supplies operating power;

a controller which receives the operating power;

a high voltage transformer having primary and secondary coils, wherein the high voltage transformer induces the AC power as a high AC voltage according to a turn ratio of the primary coil to the secondary coil;

a high voltage unit which generates a high DC voltage from the high AC voltage induced by the high voltage transformer and supplies the high DC voltage to the magnetron; and a filter unit which blocks high frequency noise while passing a signal of a DC voltage through ground lines to which the low and high voltage units are grounded and a power line connected between the low voltage unit and the controller.

2. The microwave oven according to claim 1, wherein the filter unit includes at least one choke coil which increases impedances of the ground and the power lines.

3. The microwave oven according to claim 1, wherein the microwave oven is a microwave oven usable with a power source selected from DC and AC power sources.

4. The microwave oven according to claim 1, wherein the low voltage unit comprises:

a switching unit which selectively blocks power and supplies the operating power; and an inverter unit which converts the DC power to the AC power according to the controller and is connected to the primary coil.

5. The microwave oven according to claim 4, wherein the high voltage unit comprises a magnetron driving unit connected to the secondary coil, wherein the power line is connected between the primary coil of the high voltage transformer and the controller, and ends of the switching unit and the magnetron driving unit are grounded through corresponding ones of the ground lines.

6. The microwave oven according to claim 1, wherein the filter unit comprises first, second and third filter choke coils which include corresponding inductances and increase impedances of the ground and power lines, respectively.

7. The microwave oven according to claim 6, wherein the first and second filter choke coils are disposed on corresponding ones of the ground lines and the third filter choke coil is disposed on the power line.

8. The microwave oven according to claim 7, wherein the low voltage unit comprises:

a switching unit which selectively blocks power and supplies the operating power; and an inverter unit which converts the DC power to the AC power according to the controller and is connected to the primary coil.

9. The microwave oven according to claim 8, wherein the high voltage unit comprises a magnetron driving unit connected to the secondary coil, wherein the power line is connected between the primary coil of the high voltage transformer and the controller, and ends of the switching unit and the magnetron driving unit are grounded through the corresponding ones of the ground lines.

10. The microwave oven according to claim 9, further comprising a magnetron filter box including the magnetron and a low pass filter.

11. The microwave oven according to claim 10, wherein the low pass filter comprises at least one choke coil and a feed-through condenser which remove driving noise due to a driving of the magnetron.

12. The microwave oven according to claim 1, further comprising a magnetron filter box including the magnetron and a low pass filter.

13. The microwave oven according to claim 12, wherein the low pass filter comprises at least one choke coil and a feed-through condenser which remove driving noise due to a driving of the magnetron.

14. A microwave oven comprising:

a low voltage unit which converts direct current (DC) power into alternating current (AC) power and supplies operating power;

a controller which receives the operating power;

a high voltage transformer which induces the AC power as a high AC voltage;

a high voltage unit which generates a high DC voltage from the high AC voltage; and a filter unit which blocks high frequency noise while passing a signal of a DC voltage through ground lines to which the low and high voltage units are grounded and a power line connected between the low voltage unit and the controller.

15. The microwave oven according to claim 14, wherein the filter unit includes at least one filter choke coil which increases impedances of the ground and the power lines.

16. The microwave oven according to claim 15, wherein the high voltage transformer comprises primary and secondary coils, and induces the AC power as the high AC voltage according to a turn ratio of the primary coil to the secondary coil.

17. The microwave oven according to claim 16, wherein the high frequency noise is generated due to electrical energy flows between the low and high voltage units.

18. The microwave oven according to claim 14, wherein the filter unit comprises first, second and third filter choke coils which include corresponding inductances and increase impedances of the ground and power lines, respectively.

19. The microwave oven according to claim 18, wherein the first and second filter choke coils are disposed on corresponding ones of the ground lines and the third filter choke coil is disposed on the power line.

20. The microwave oven according to claim 19, wherein the high voltage transformer comprises primary and secondary coils, and induces the AC power as the high AC voltage according to a turn ratio of the primary coil to the secondary coil.

21. A microwave oven comprising:

a low voltage unit which converts a first DC voltage into an AC voltage;

a high voltage unit which converts the AC voltage from the low voltage unit into a second DC voltage of a level higher than the first DC voltage;

a controller; and a filter unit which blocks high frequency noise generated between the low and high voltage units while passing a signal of a direct current (DC) voltage through lines to one or more potentials, to which the low and high voltage units are connected, and/or through a power line connected between the low voltage unit and the controller, the filter unit disposed on ground lines and disposed on a power line connected between the low voltage unit and the controller, which blocks high frequency noise while passing a signal of a DC voltage through the ground lines to which the low and high voltage units are grounded and the power line connected between the low voltage unit and the controller.

22. The microwave oven according to claim 21, wherein the filter unit includes at least one filter choke coil which increases one or more impedances of corresponding ones of the lines and the power line.

23. The microwave oven according to claim 21, wherein the filter unit comprises first, second and third filter choke coils which include corresponding inductances, and increase impedances of the lines and the power line, respectively.

24. The microwave oven according to claim 23, wherein the first and second filter choke coils are disposed on corresponding ones of the lines and the third filter choke coil is disposed on the power line.

* * * * *